US008210153B2

(12) United States Patent
Otaki

(10) Patent No.: US 8,210,153 B2
(45) Date of Patent: Jul. 3, 2012

(54) INTAKE MANIFOLD

(75) Inventor: Kazuyuki Otaki, Kariya (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 292 days.

(21) Appl. No.: 12/499,279

(22) Filed: Jul. 8, 2009

(65) Prior Publication Data

US 2010/0012070 A1 Jan. 21, 2010

(30) Foreign Application Priority Data

Jul. 18, 2008 (JP) ..... 2008-187511

(51) Int. Cl.
*F02D 9/10* (2006.01)
*F02M 35/10* (2006.01)

(52) U.S. Cl. ..... 123/306; 123/184.56

(58) Field of Classification Search ..... 123/184.21–184.61, 306, 336, 337
See application file for complete search history.

(56) References Cited

U.S. PATENT DOCUMENTS

| | | | | |
|---|---|---|---|---|
| 7,997,247 | B2 * | 8/2011 | Akihisa et al. | 123/184.56 |
| 2001/0025627 | A1 * | 10/2001 | Lamb et al. | 123/456 |
| 2002/0073961 | A1 * | 6/2002 | Tanaka et al. | 123/336 |
| 2005/0045139 | A1 * | 3/2005 | Fagala | 123/184.56 |
| 2007/0017473 | A1 * | 1/2007 | Kondo et al. | 123/184.53 |
| 2008/0035107 | A1 * | 2/2008 | Torii | 123/336 |
| 2009/0007875 | A1 * | 1/2009 | Sano et al. | 123/184.53 |
| 2009/0050094 | A1 * | 2/2009 | Sano | 123/184.21 |
| 2009/0050098 | A1 * | 2/2009 | Sano et al. | 123/184.61 |
| 2009/0164097 | A1 * | 6/2009 | Uda | 701/103 |
| 2009/0235891 | A1 * | 9/2009 | Kamiya | 123/184.53 |

FOREIGN PATENT DOCUMENTS

| | | |
|---|---|---|
| JP | 9-303163 | 11/1997 |
| JP | 2005-337057 | 12/2005 |
| JP | 2007-113482 | 5/2007 |
| JP | 2008-038816 | 2/2008 |
| JP | 2008-45430 | 2/2008 |
| JP | 2009-228502 | 10/2009 |

OTHER PUBLICATIONS

English language Abstract of JP 2007-113482, May 10, 2007.
English language Abstract of JP 2008-45430, Feb. 28, 2008.
JAPAN Office action, mail date is Mar. 21, 2012.

* cited by examiner

*Primary Examiner* — John T. Kwon
*Assistant Examiner* — Johnny Hoang
(74) *Attorney, Agent, or Firm* — Greenblum & Bernstein, P.L.C.

(57) ABSTRACT

An intake manifold includes a manifold case having an intake passage. A valve is arranged in the intake passage. The valve is rotatable about its proximal end so as to partly close the intake passage. When the valve partly closes the intake passage, a clearance is formed between a wall surface defining the intake passage and a distal end of the valve. The clearance connects a section of the intake passage upstream of the valve and a section of the intake passage downstream of the valve to each other. When the valve partly closes the intake passage, each of side edges of the valve comes in surface-to-surface contact with a portion of the intake passage wall surface that faces the side edge of the valve, thereby airtightly sealing the spaces between the side edges of the valve and the wall surface of the intake passage.

7 Claims, 6 Drawing Sheets

INTAKE MANIFOLD

BACKGROUND OF THE INVENTION

The present invention relates to an intake manifold for an engine, and more particularly to an intake manifold that is suitable for promoting generation of tumble flow or swirl flow in cylinders of an engine.

For example, Japanese Laid-Open Patent Publication No. 2007-113482 and Japanese Laid-Open Patent Publication No. 2008-45430 disclose such typical intake manifolds.

The intake manifold disclosed in Japanese Laid-Open Patent Publication No. 2007-113482 is made of synthetic resin and has an intake passage connected to one of intake ports of an engine. A downstream section of the intake passage is divided into upper and lower regions by a partition. A synthetic resin valve for opening and closing the lower region in the intake passage is provided in the intake passage at a position upstream of the partition. When the lower region in the intake passage is closed by the valve, flow of air that flows into one of engine cylinders from the intake manifold through the upper region in the intake passage generates tumble flow in the engine cylinder.

In the case of this intake manifold, molding distortion in the synthetic resin intake manifold and valve can cause the side edges of the valve to interfere with wall surface that defines the intake passage to such an extent that the side edges hinder the operation of the valve. To eliminate such a drawback, it is inevitable that a clearance is provided between each side edge of the valve and a portion of the intake passage wall surface that faces the side edge of the valve. Therefore, when the lower region in the intake passage is closed by the valve, air flows into one of the engine cylinders from the intake manifold not only through the upper region in the intake passage, but also through the clearances. This disadvantageously reduces the efficiency of generation of tumble flow in the corresponding engine cylinder.

The intake manifold disclosed in Japanese Laid-Open Patent Publication No. 2008-45430 is made of synthetic resin and has intake passages each connected to one of intake ports of an engine. A synthetic resin valve is arranged in each intake passage. The valves are supported at their proximal ends by a shaft. Each valve rotates integrally with the shaft to open and close the corresponding intake passage. Each valve has a slit, which is formed by cutting out a part of the distal end of the valve. When each intake passage is closed by the corresponding valve, the slit of the valve allows air to flow therethrough to one of the engine cylinders. The airflow through the slit of each valve generates tumble flow in the corresponding engine cylinder.

In the case of this intake manifold also, it is inevitable that a clearance is provided between each side edge of each valve and a portion of the corresponding intake passage wall surface that faces the side edge of the valve. Therefore, when each intake passage is closed by the corresponding valve, air flows into the engine cylinders from the intake manifold not only through the slits of the valves, but also through the clearances. This disadvantageously reduces the efficiency of generation of tumble flow in the cylinders.

SUMMARY OF THE INVENTION

Accordingly, it is an objective of the present invention to provide an intake manifold that is capable of reliably promoting generation of tumble flow or swirl flow in engine cylinders.

To achieve the foregoing objective and in accordance with one aspect of the present invention, an intake manifold including a manifold case and a valve is provided. The manifold case has an intake passage. The valve is arranged in the intake passage. The valve is rotatable about its proximal end so as to partly close the intake passage. When the valve partly closes the intake passage, a clearance is formed between a wall surface defining the intake passage and a distal end of the valve. The clearance connects a section of the intake passage upstream of the valve and a section of the intake passage downstream of the valve to each other. When the valve partly closes the intake passage, each of side edges of the valve comes in surface-to-surface contact with a portion of the intake passage wall surface that faces the side edge of the valve, thereby airtightly sealing the spaces between the side edges of the valve and the wall surface of the intake passage.

In a preferred embodiment, a stepped portion is provided in each of the portions of the wall surface of the intake passage. The surface-to-surface contact of the side edges of the valve with the portions of the wall surface of the intake passage is achieved when each side edge of the valve contacts one of the stepped portions.

In a preferred embodiment, portions of the valve that comes in surface-to-surface contact with the stepped portions each have a width that increases toward the clearance between the wall surface of the intake passage and the distal end of the valve.

In a preferred embodiment, each side edge of the valve and the corresponding stepped portion are formed to be fitted to each other.

In a preferred embodiment, each side edge of the valve and the corresponding stepped portion each have one of a projection having an acute-angled cross-sectional shape and a recess having an acute-angled cross-sectional shape. The fitting of each side edge of the valve and the corresponding stepped portion is achieved by fitting the projection and the recess of the side edge and the stepped portion to each other.

In a preferred embodiment, a labyrinth structure is formed between each side edge of the valve and the wall surface of the intake passage when the side edge is fitted to the corresponding stepped portion.

In a preferred embodiment, each side edge of the valve comes in surface-to-surface contact, through a sealing member, with the corresponding one of the portions of the wall surface of the intake passage.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 to 6.

Figure 1:
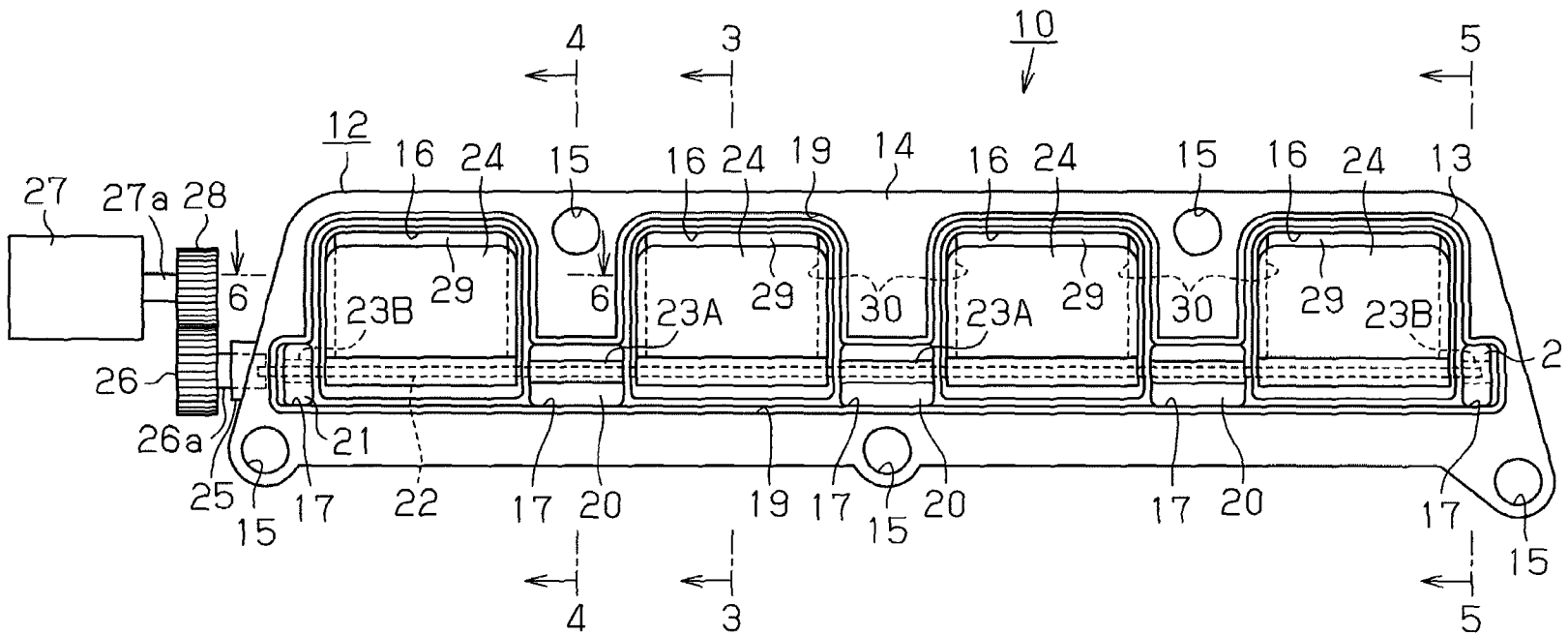
FIG. 1 is a front view illustrating an intake manifold according to a first embodiment of the present invention.
Figure 2:
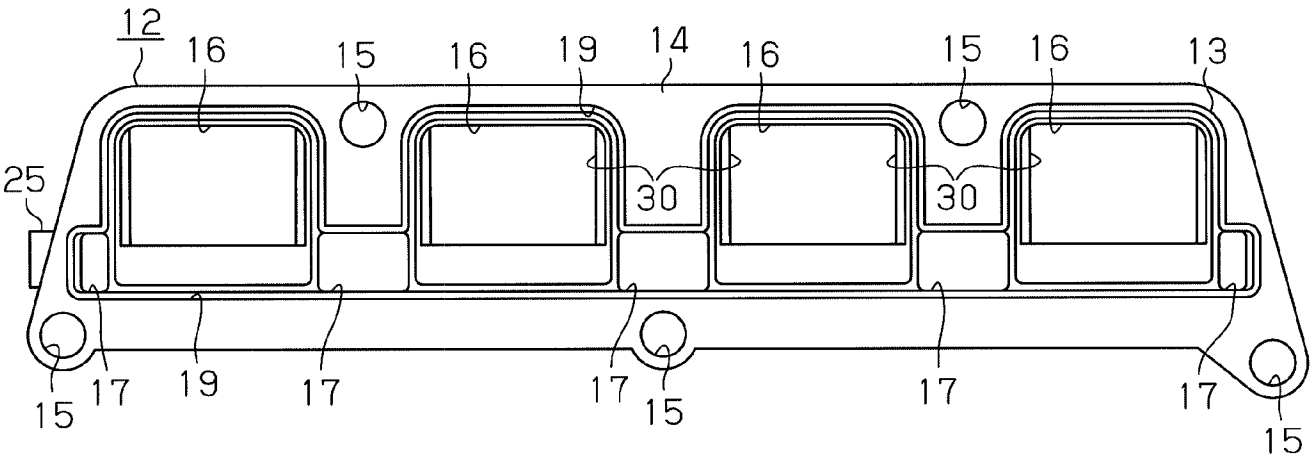
FIG. 2 is a front view of the manifold case of the intake manifold shown in FIG. 1.
Figure 3:
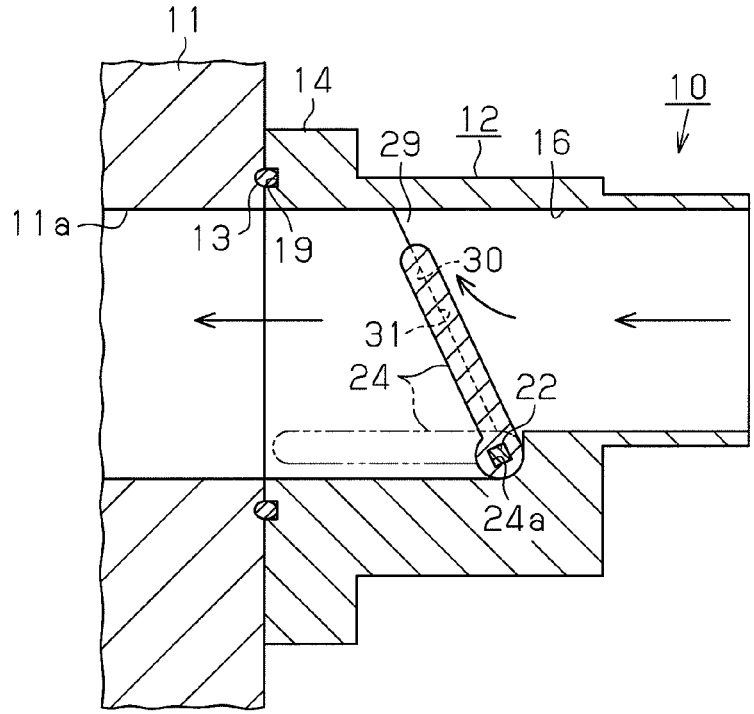
FIG. 3 is a cross-sectional view taken along line 3-3 in FIG. 1.

As shown in FIGS. 1 to 3, an intake manifold 10 according to the present embodiment includes a manifold case 12, which is made of synthetic resin such as polyamide resin (for example, 6-nylon) reinforced with glass fibers. The manifold case 12 has a flange portion 14 at front. The flange portion 14 has a plurality of through holes 15. The manifold case 12 is fixed to a cylinder head 11 of an engine by means of bolts (not shown) inserted into the through holes 15 with the flange portion 14 contacting the cylinder head 11.

Figure 4:
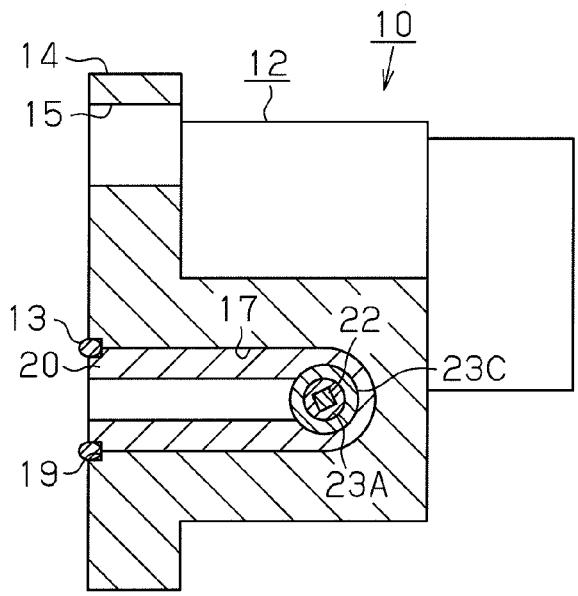
FIG. 4 is a cross-sectional view taken along line 4-4 in FIG. 1.
Figure 5:
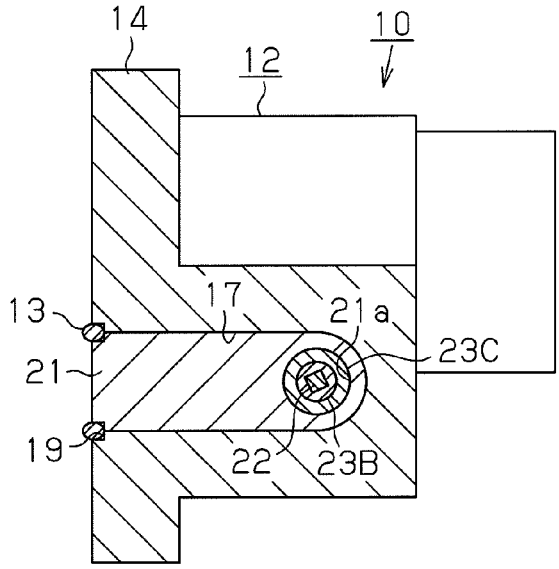
FIG. 5 is a cross-sectional view taken along line 5-5 in FIG. 1.

A plurality of intake passages 16 are formed in the manifold case 12. Each intake passage 16 is connected to one of intake ports 11*a* provided in the cylinder head 11. Each intake passage 16 has a rectangular cross section. As shown in FIGS. 2, 4, and 5, a recess 17 is formed in a portion of the manifold case 12 on each side of each intake passage 16. A looped groove 19 is formed in the front face of the manifold case 12 so as to encompass all the openings of the intake passages 16 and the recesses 17. A gasket 13 is received in the groove 19.

As shown in FIGS. 1, 4, and 5, each of the recesses 17, except the outer most ones, receives a synthetic resin bearing 20 having a U-shaped cross section. Each of the outermost recesses 17 receives a synthetic resin bearing 21 having a support hole 21*a*. A metal shaft 22 having a square cross section is rotatably supported by the bearings 20 and the bearings 21. More specifically, metal sleeves 23A are fitted about the shaft 22 at positions corresponding to the bearings 20. Each of the bearings 20 has a metal collar 23C that does not rotate relative to the bearing 20, but rotatably supports the corresponding sleeve 23A. Metal sleeves 23B are fitted about the shaft 22 at positions corresponding to the bearings 21. Each of the bearings 21 has a metal collar 23C that does not rotate relative to the bearing 21, but rotatably supports the corresponding sleeve 23B. The collar 23C of each bearing 21 is arranged in the support hole 21*a* of the bearing 21.

Figure 6:
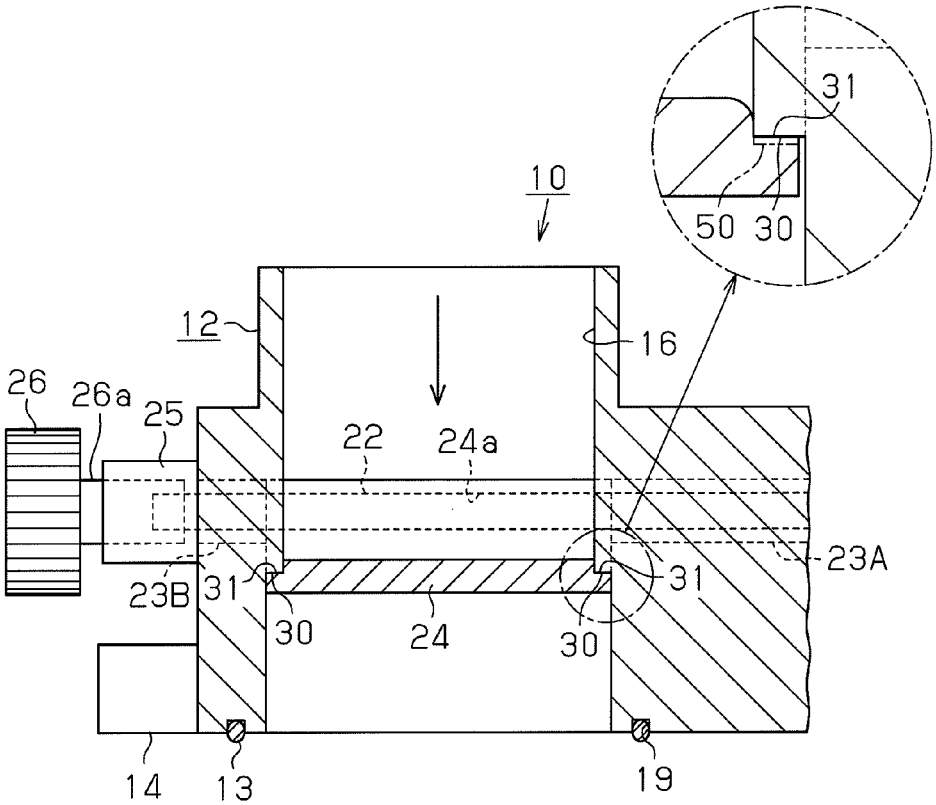
FIG. 6 is a part of a cross-sectional view taken along line 6-6 in FIG. 1.

As shown in FIGS. 1, 3, and 6, a synthetic resin valve 24 is provided in each intake passage 16. Each valve 24 has an insertion hole 24*a* at its proximal end. The valves 24 are supported by the shaft 22, which is passed through the insertion holes 24*a*. By integrally rotating with the shaft 22, each valve 24 opens and closes the corresponding intake passage 16. A support cylinder 25 projects from one side of the manifold case 12. The support cylinder 25 rotatably supports a boss 26*a* of a driven gear 26 with a metal collar (not shown) in between. One end of the shaft 22 is coupled to the boss 26*a* of the driven gear 26. This allows the shaft 22 to rotate integrally with the driven gear 26.

As shown in FIG. 1, a motor 27 is located in the vicinity of the manifold case 12. A motor shaft 27*a* of the motor 27 is fixed to a drive gear 28, which meshes with the driven gear 26. When the drive gear 28 rotates together with the motor shaft 27*a*, the shaft 22 is rotated through the driven gear 26. As a result, each valve 24 is switched between a closed position shown by a solid line in FIG. 3 and an open position shown by a alternate long and two short dashes line. When each valve 24 is located at the closed position, a narrow clearance 29 is formed between a wall surface defining the corresponding intake passage 16 and the distal end of the valve 24. The clearance 29 connects the upstream section and the downstream section of the intake passage 16 to each other. That is, when each valve 24 is at the closed position, the corresponding intake passage 16 is partly closed by the valve 24. At this time, the flow of air that is introduced to each intake port 11*a* of the engine through the clearance 29 in the corresponding intake passage 16 generates tumble flow in the corresponding engine cylinder.

As shown in FIGS. 3 and 6, a perpendicularly stepped projection 30 is formed in each of portions of the wall surface of each intake passage 16, which portions each face one of side edges of the corresponding valve 24 when the valve 24 is at the closed position. When each valve 24 is moved to the closed position, each side edge of the valve 24 comes in surface-to-surface contact with the corresponding stepped projection 30 in the corresponding intake passage 16. More specifically, a perpendicularly stepped recess 31 is formed at each side edge of each valve 24. When each valve 24 is moved to the closed position, each stepped projection 30 in the corresponding intake passage 16 is fitted in one of the stepped recesses 31 of the valve 24. This airtightly seals the spaces between the side edges of each valve 24 and the wall surface of the corresponding intake passage 16.

The intake manifold 10 is assembled in the following manner.

First, the shaft 22 is passed through the insertion holes 24*a* of the valves 24 such that the valves 24 are supported by the shaft 22. The valves 24 are arranged at equal intervals. Then, the sleeve 23A or the sleeve 23B is fitted about the shaft 22 at a position on each side of each valve 24. The collar 23C is provided about each of the sleeves 23A, 23B in advance. Thereafter, the collars 23C are supported by the bearings 20 and the bearings 21.

The thus obtained assembly of the valves 24, the shaft 22, and the bearings 20, 21 is subsequently installed in the manifold case 12. At this time, each valve 24 is accommodated in the corresponding intake passage 16 of the manifold case 12, and each bearing 20, 21 is fitted in the corresponding recess 17 of the manifold case 12. Thereafter, the boss 26*a* of the driven gear 26 is inserted to the support cylinder 25 of the manifold case 12, so that the boss 26*a* is fitted to one end of the shaft 22. Finally, the gasket 13 is fitted in the groove 19 of the manifold case 12. This completes the assembly of the intake manifold 10. The completed intake manifold 10 is fixed to the cylinder head 11 by means of the bolts with the flange portion 14 of the manifold case 12 contacting the cylinder head 11 as shown in FIG. 3.

When there is a demand for high engine speed, the valves 24 receive power from the motor 27 and rotate about their proximal ends integrally with the shaft 22, and are moved to the open position, which is shown by alternate long and two short dashes line in FIG. 3. As a result, the intake passages 16 are opened, and air introduced through the open intake passages 16 allows the engine to run at a high speed.

When there is a demand for low engine speed, the valves 24 receive power from the motor 27 and rotate integrally with the shaft 22, and are moved to the closed position, which is shown by solid line in FIG. 3. As a result, each intake passage 16 is partly closed by the corresponding valve 24, so that air is introduced into the engine cylinders through the narrow clearances 29 between the wall surfaces of the intake passages 16 and the distal ends of the valves 24. This flow of air generates tumble flow in each engine cylinder.

The first embodiment has the following advantages.

When each valve 24 is at the closed position, the spaces between the side edges of the valve 24 and the wall surface of the corresponding intake passage 16 are airtightly sealed. If the sealing is not airtight, air flows through the spaces between the side edges of each valve 24 and the wall surfaces of the corresponding intake passage 16, and hinders generation of tumble flow in each engine cylinder. Therefore, airtight sealing between the side edges of each valve 24 and the wall surface of the corresponding intake passage 16 when the valve 24 is at the closed position is advantageous for efficiently generating tumble flow in each engine cylinder.

Airtight sealing between the side edges of each valve 24 and the wall surface of the corresponding intake passage 16 is achieved by causing each side edge of the valve 24 to come in surface-to-surface contact with the corresponding stepped projection 30 of the intake passage 16. Thus, even if the manifold case 12 is deformed due to, for example, shrinkage, the side edges of each valve 24 are prevented from interfering with the wall surface of the corresponding intake passage 16 to such an extent that the side edges hinder the operation of the valve 24. Also, spaces are not formed between the side edges and the wall surface.

When each valve 24 is moved to the closed position, each of the stepped projections 30 on the wall surface of the corresponding intake passage 16 is fitted in one of the stepped recesses 31 formed on the side edges of the valve 24. This improves the airtightness between the side edges of each valve 24 and the wall surface of the corresponding intake passage 16.

Each of the side edges of each valve 24 comes in surface-to-surface contact with one of the stepped projections 30 of the corresponding intake passage 16. This configuration is advantageous in accurately determining the position of each valve 24 at the closed position.

A second embodiment will now be described. The differences from the first embodiment will be mainly discussed.

Figure 7:
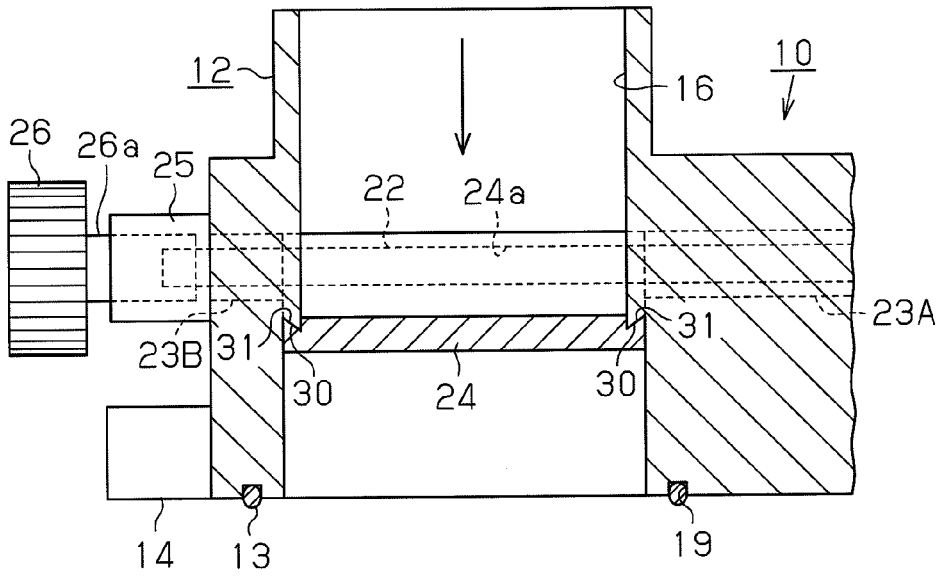
FIG. 7 is a cross-sectional view showing a part of an intake manifold according to a second embodiment of the present invention.

As shown in FIG. 7, an intake manifold 10 according to the second embodiment is different from the intake manifold 10 according to the first embodiment in that stepped projections 30 formed on a wall surface defining each intake passage 16 have acute-angled cross-sectional shapes. Also, unlike the intake manifold 10 of the first embodiment, stepped recesses 31 formed on the side edges of each valve 24 have acute-angled cross-sectional shapes. As in the case of the first embodiment, when each valve 24 is moved to the closed position, each of the stepped projections 30 on the wall surface of the corresponding intake passage 16 is fitted in one of the stepped recesses 31 formed on the side edges of the valve 24. This airtightly seals the spaces between the side edges of each valve 24 and the wall surface of the corresponding intake passage 16.

In addition to the advantages of the first embodiment, the second embodiment has the following advantage.

The stepped projections 30 and the stepped recesses 31 each have an acute-angled cross-sectional shape. This further improves the airtightness between the side edges of each valve 24 and the wall surface of the corresponding intake passage 16, which is improved by causing each stepped projection 30 of the intake passage 16 to be fitted in one of the stepped recess 31 of the valve 24.

A third embodiment will now be described. The differences from the first embodiment will be mainly discussed.

Figure 8:
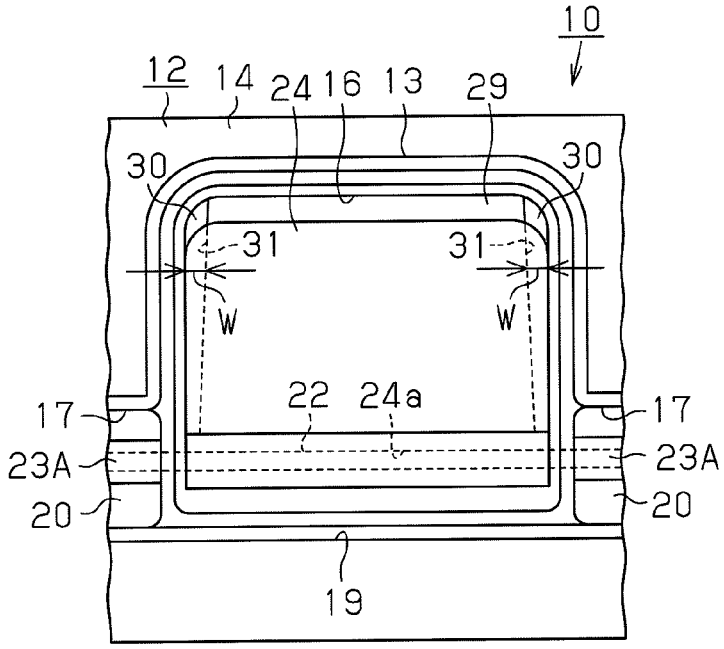
FIG. 8 is a front view showing a part of an intake manifold according to a third embodiment of the present invention.

In the first embodiment, the stepped projections 30 each have a constant width. In contrast, as shown in FIG. 8, stepped projections 30 formed on a wall surface defining each intake passage 16 of the third embodiment each have a width that increases toward the clearance 29 in the intake passage 16. Also, unlike the first embodiment, in which the stepped recess 31 formed on each side edge of each valve 24 has a constant width, a stepped recess 31 formed on each side edge of each valve 24 of the third embodiment has a width that increases toward the clearance 29 in the intake passage 16. Therefore, the widths of portions of each valve 24 that come in surface-to-surface contact with the corresponding stepped projections 30 each increase toward the corresponding clearance 29, in other words, each increase from the proximal end toward the distal end of the valves 24.

In addition to the advantages of the first embodiment, the third embodiment has the following advantage.

When each valve 24 is at the closed position, air flow in a section upstream of the valve 24 concentrates on the clearance 29 in the corresponding intake passage 16. That is, the closer to the distal end of each valve 24, the stronger the pressure of the air flowing through the intake passage 16 acting on the valve 24 becomes. The widths of portions of each valve 24 that come in surface-to-surface contact with the corresponding stepped projections 30 each increase from the proximal end toward the distal end of the valve 24. Thus, even in a position near the distal end of each valve 24, which receives a great pressure of air flowing through the corresponding intake passage 16, airtight sealing between the side edges of the valve 24 and the wall surface of the corresponding intake passage 16 is reliably maintained.

A fourth embodiment will now be described. The differences from the first embodiment will be mainly discussed.

Figure 9:
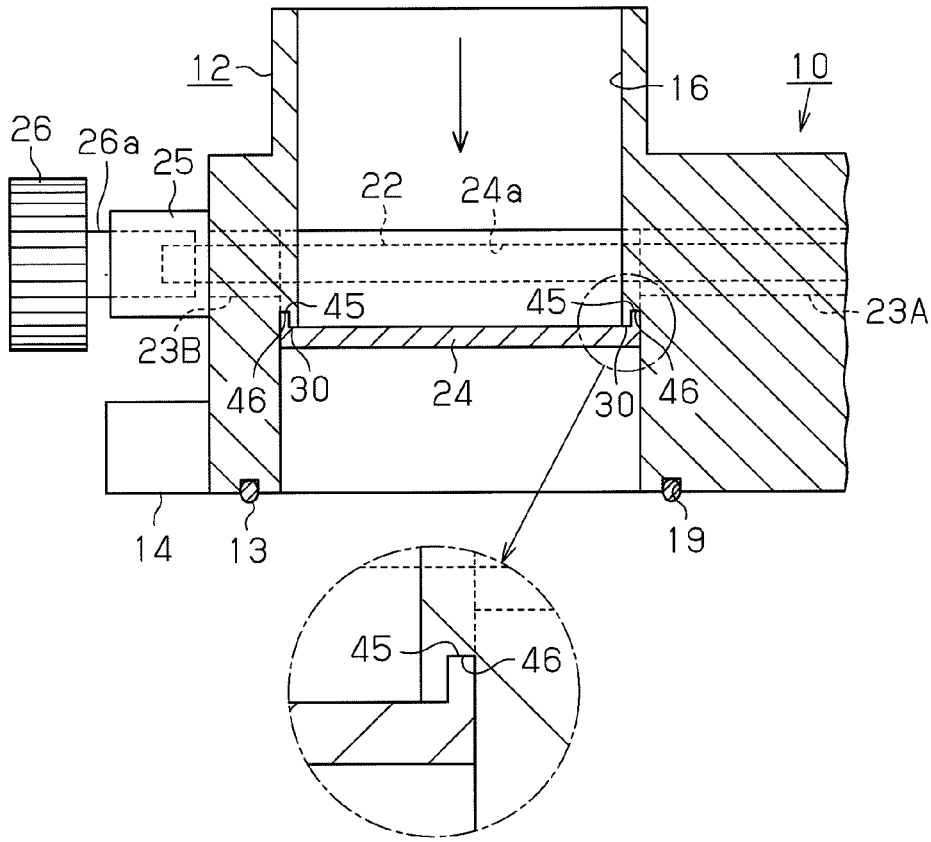
FIG. 9 is a front view showing a part of an intake manifold according to a fourth embodiment of the present invention.

As shown in FIG. 9, in place of the stepped recesses 31, an intake manifold 10 according to the fourth embodiment has a protrusion 45 on each side edge of each valve 24. Each protrusion 45 extends from the proximal end to the distal end of the corresponding valve 24. Also, a recessed portion 46 is formed in each of the stepped projections 30 provided on the wall surface that define each intake passage 16. When each valve 24 is moved to the closed position, each protrusion 45 of the valve 24 is fitted in the recessed portion 46 of one of the stepped projections 30 in the corresponding intake passage 16. This airtightly seals the spaces between the side edges of each valve 24 and the wall surface of the corresponding intake passage 16.

In addition to the advantages of the first embodiment, the fourth embodiment has the following advantage.

Airtight sealing between the side edges of each valve 24 and the wall surface of the corresponding intake passage 16 is achieved by causing the protrusion 45 on each side edge of the valve 24 to be fitted in the recessed portion 46 of one of the stepped projections 30 in the corresponding intake passage 16. The fitting of the protrusions 45 to the recessed portions 46 form a labyrinth structure between the side edges of each valve 24 and the wall surface of the corresponding intake passage 16. This further improves the airtightness between the side edges of each valve 24 and the wall surface of the corresponding intake passage 16.

The above embodiments may be modified as follows.

Figure 10:
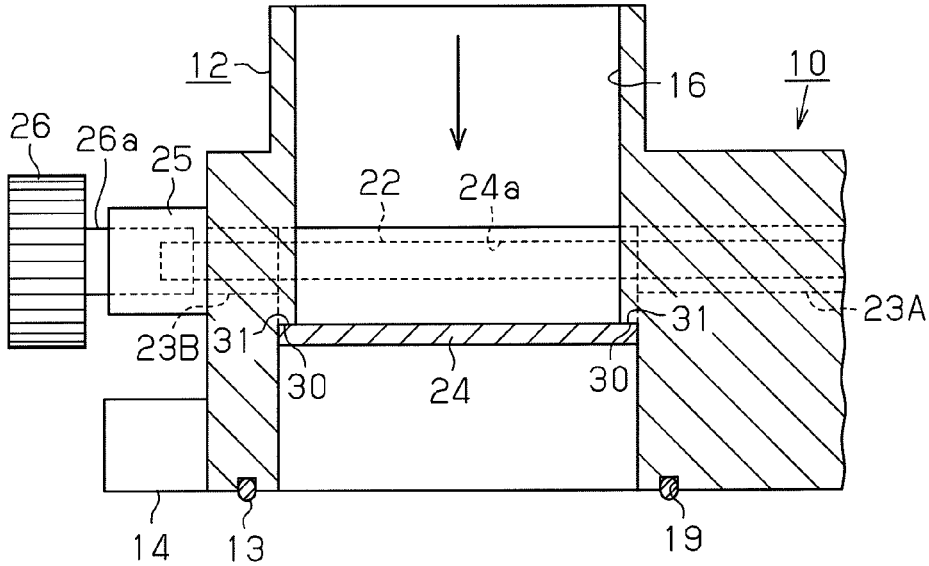
FIG. 10 is a front view showing a part of an intake manifold according to a modified embodiment of the present invention.

In the first embodiment, the stepped recess 31 on each side edge of each valve 24 may be omitted as shown in FIG. 10. In this case, when each valve 24 is moved to the closed position, each side edge of the valve 24 comes in surface-to-surface contact with one of the stepped projections 30 on the wall surface of the corresponding intake passage 16. This airtightly seals the spaces between the side edges of each valve 24 and the wall surface of the corresponding intake passage 16.

In the first embodiment, as shown by alternate long and two short dashes lines in a circle of an alternate long and short dash line in FIG. 6, a rubber sealing member 50 may be bonded either to each stepped projection 30 in each intake passage 16 or to each stepped recess 31 of each valve 24. In this case, each side edge of each valve 24 comes in surface-to-surface contact with one of the step projections 30 in the corresponding intake passage 16 through the corresponding sealing member 50. This further improves the airtightness between the side edges of each valve 24 and the wall surface of the corresponding intake passage 16.

In the intake manifold 10 of the second embodiment shown in FIG. 7, each stepped projection 30 may have a width that increases toward the clearance 29 in the corresponding intake passage 16, and each stepped recess 31 may have a width that increases toward the clearance 29 in the corresponding intake passage 16 as in the third embodiment shown in FIG. 8.

The intake manifolds 10 of the previous embodiments are capable of promoting generation of tumble flow in engine cylinders. However, the present invention may be applied to other types of intake manifolds. For example, the present invention may be applied to an intake manifold that is capable of promoting generation of swirl flow in engine cylinders. In this case, when each valve is at the closed position, the position of clearance, which is formed between the distal end of the valve and the wall surface defining the corresponding intake passage and connects the upstream and downstream sections of the intake passage to each other, is on the left side or the right side in the intake passage, instead of being in an upper portion of the intake passage as in the above embodiments.

The invention claimed is:

1. An intake manifold, comprising:

a manifold case having an intake passage; and a valve arranged in the intake passage, the valve having a distal end, a proximal end, and side edges, wherein the valve is rotatable about the proximal end so as to partly close the intake passage, wherein when the valve partly closes the intake passage, a clearance is formed between a wall surface of the intake passage and the distal end of the valve, the clearance connecting a section of the intake passage upstream of the valve and a section of the intake passage downstream of the valve to each other, wherein when the valve partly closes the intake passage, each side edge of the valve comes in surface-to-surface contact with a stepped portion of the intake passage wall surface that faces each side edge of the valve, the stepped portion being provided in each portion of the intake passage wall surface that faces each side edge of the valve, the stepped portion extending along the intake passage along an entire height of each side edge of the valve, and wherein when each side edge of the valve contacts each stepped portion, spaces between the side edges of the valve and the corresponding wall surfaces of the intake passage are airtightly sealed.

2. The intake manifold according to claim 1, wherein a width of each side edge of the valve that comes in the surface-to-surface contact with the stepped portions of the intake passage increases from the proximal end of the valve toward the distal end of the valve.

3. The intake manifold according to claim 1, wherein each side edge of the valve and the corresponding stepped portion are formed to be fitted to each other.

4. The intake manifold according to claim 3, wherein each side edge of the valve and the corresponding stepped portion each have one of a projection having an acute-angled cross-sectional shape and a recess having an acute-angled cross-sectional shape, and wherein the fitting of each side edge of the valve and the corresponding stepped portion is achieved by fitting the projection and the recess of the side edge and the stepped portion to each other.

5. The intake manifold according to claim 3, wherein a labyrinth structure is formed between each side edge of the valve and the wall surface of the intake passage when the side edge is fitted to the corresponding stepped portion.

6. The intake manifold according to claim 1, wherein each side edge of the valve comes in the surface-to-surface contact, through a sealing member, with the corresponding stepped portion of the wall surface of the intake passage.

7. The intake manifold according to claim 1, wherein each stepped portion of the intake passage that comes in the surface-to-surface contact with each side edge of the valve has a width that increases from the proximal end of the valve towards the distal end of the valve.

* * * * *